US007497726B2

(12) United States Patent
Wang et al.

(10) Patent No.: US 7,497,726 B2
(45) Date of Patent: Mar. 3, 2009

(54) STACKABLE CONNECTOR ASSEMBLY

(75) Inventors: Ching-Jen Wang, Taipei (TW); Chu-Chieh Pan, Taipei (TW); Chih-hao Kuo, Taipei (TW)

(73) Assignee: ASUSTeK Computer Inc., Taipei (TW)

( * ) Notice: Subject to any disclaimer, the term of this patent is extended or adjusted under 35 U.S.C. 154(b) by 0 days.

(21) Appl. No.: 11/717,113

(22) Filed: Mar. 13, 2007

(65) Prior Publication Data

US 2007/0293083 A1 Dec. 20, 2007

(30) Foreign Application Priority Data

Jun. 14, 2006 (TW) ..... 95121313 A

(51) Int. Cl.
*H01R 13/66* (2006.01)
*H01R 13/60* (2006.01)

(52) U.S. Cl. ..... 439/541.5; 439/607

(58) Field of Classification Search ..... 439/541.5, 439/607
See application file for complete search history.

(56) References Cited

U.S. PATENT DOCUMENTS 5,085,590 A 2/1992 Galloway
5,167,531 A 12/1992 Broschard
6,099,351 A * 8/2000 Wu ..... 439/607
6,183,292 B1 2/2001 Chen
6,213,813 B1 * 4/2001 Huang ..... 439/607
6,319,061 B1 * 11/2001 Chen et al. ..... 439/607
6,347,961 B2 * 2/2002 Zhu et al. ..... 439/607

FOREIGN PATENT DOCUMENTS

CN 2717055 Y 8/2005
TW 458402 Y 10/2001
TW 488568 Y 5/2002
TW 510604 Y 11/2002

* cited by examiner

*Primary Examiner*—Javaid Nasri
(74) *Attorney, Agent, or Firm*—Muncy, Geissler, Olds & Lowe, PLLC

(57) ABSTRACT

This invention discloses a stackable connector assembly, which includes a first connector, a second connector, a shielding member, a contact member, and a ground member. The second connector is placed above the first connector. The shielding member is covered on the first connector. The contact member is used for connecting the shielding member and the ground member. This structure can reduce the electromagnetic radiation from the first connector.

7 Claims, 9 Drawing Sheets

STACKABLE CONNECTOR ASSEMBLY

RELATED APPLICATIONS

The present application is based on, and claims priority from, Taiwan Application Serial Number 95121313, filed Jun. 14, 2006, the disclosure of which is hereby incorporated by reference herein in its entirety.

BACKGROUND

1. Field of Invention

The present invention relates to a connector assembly. More particularly, the present invention relates to a stackable connector assembly.

2. Description of Related Art

Computers have only a half-century long history, but they are evolving with an extremely fast pace. A variety of peripheral device and a variety of transmission interface are introducing with the generations of the CPU to expand the function of the computer or increase the data transmission speed. Moreover, computers have made great progress and have become extremely versatile in the last few years, the number of built-in interfaces on the motherboard are also increased very fast. However, every interface correspond a specific connecter as a transporting channel. Therefore, the amount of connector increases very fast. Due to this reason, the stackable connector is introduced to provide multiple interface ports in a restricted area of the motherboard.

Referring to FIG. 1. FIG. 1 is a schematic diagram of a front view of a common stackable connector assembly. A first connector 102 and a second connector 104 are mounted on metal brackets 106. The second connector 104 is arranged above the first connector 102. The metal brackets 106 can increase the strength of the stackable connector assembly 100. A connective line 108 is configured between the second connector 104 and a motherboard 114, and used for transmitting signals between the second connector 104 and the motherboard 114.

FIG. 2 is a schematic diagram of an exploded view of a connector 200. The connector includes a connector body 202, a raised portion 204, and an electrically conductive shell 206. The raised portion 204 protrudes from one side of the connector body 202. The electrically conductive shell 206 is covered on the raised portion 204 and one side of the connector body 202. The electrically conductive shell 206 is used to protect the raised portion 204 from physical harm.

Moreover, the electrically conductive shell 206 also can be a metallic shielding shell and provide EMI shielding. When an external signal cable is connected to the raised portion 204, the electrically conductive shell 206 can shielding the electromagnetic radiation form the raised portion 204 in the data transmission process. Therefore, the electromagnetic radiation can not be radiated from the raised portion 204 toward the outside environment when the high-speed data transmission.

In general, there are two types of interfaces, the high-speed interface and the low-speed interface. The high-speed interface has a higher data transfer rate in unit time, such as VGA port. The low-speed interface has a lower data transfer rate in unit time, such as serial port. Because of the signal integrity, the high-speed interface of the stackable connector assembly is always configured near the motherboard. Therefore, the low-speed interface of the stackable connector assembly is always configured above the high-speed interface connector.

Please refer to FIG. 3. FIG. 3 is a schematic diagram of a side view of a common stackable connector assembly from the A direction of FIG. 1. There is no EMI protection between the first connector 102 and the second connector 104 in the common design of the stackable connector. However, the first connector radiates the strong electromagnetic radiation 304, 306, and 308. When the motherboard is installed in the computer case, the I/O shielding 302 could cover the connectors. Only the raised portions of the connectors protrude from the I/O shielding 302. The I/O shielding 302 is used to prevent dust or foreign matter into the computer case to damage electronic components. Furthermore, the I/O shielding 302 is also in contact with the computer case, and is grounded by the computer case.

The I/O shielding 302 could shield the electromagnetic radiation 304. The other electromagnetic radiation noise 306 and 308 could couple to the second connector 104 and make the signal unstable on second connector.

Therefore, it is desirable to reduce the electromagnetic interference from the high-speed connector of a stackable connector assembly in most cost effective way, and increase the signal stability of the two connectors of a stacked connector.

SUMMARY

It is therefore an aspect of the present invention to provide a stackable connector assembly with an EMI shielding structure to reduce the electromagnetic interference from the high-speed connector of the stackable connector assembly, and increase the signal stability of the two connectors of the stacked connector.

The stackable connector assembly includes a first connector, a second connector, a shielding member, and a ground member. The second connector is placed above the first connector. The shielding member is covered on the first connector. A contact member is a portion of the shielding member and is in contact with the ground member. Therefore, the shielding member can contact to the ground member with the contact member.

Moreover, the first connector further comprises a first raised portion. The first raised portion protrudes from one side of the first connector and is covered by an electrically conductive shell. The shielding member is grounded by a connection to the electrically conductive shell with the contact member in one embodiment.

The stackable connector assembly further comprises at least one metal bracket for increasing the strength of the stackable connector assembly. In another embodiment, the shielding member is grounded by connecting it to the metal bracket with the contact member.

The grounded shielding member is covered on the first connector, disposed between the first connector and the second connector and grounded by connecting it to the ground member with the contact member. Therefore, reducing the electromagnetic interference from the first connector, and increasing the signal stability of the two connectors of the stacked connector. Also this present invention is a low cost solution for the electromagnetic interference problem because the shielding member is made of a thin metal in most of embodiments of this present invention.

It is to be understood that both the foregoing general description and the following detailed description are examples and are intended to provide further explanation of the invention as claimed.

BRIEF DESCRIPTION OF THE DRAWINGS

These and other features, aspects, and advantages of the present invention will become better understood with regard to the following description, appended claims, and accompanying drawings where:

DESCRIPTION OF THE PREFERRED EMBODIMENTS

Figure 1:
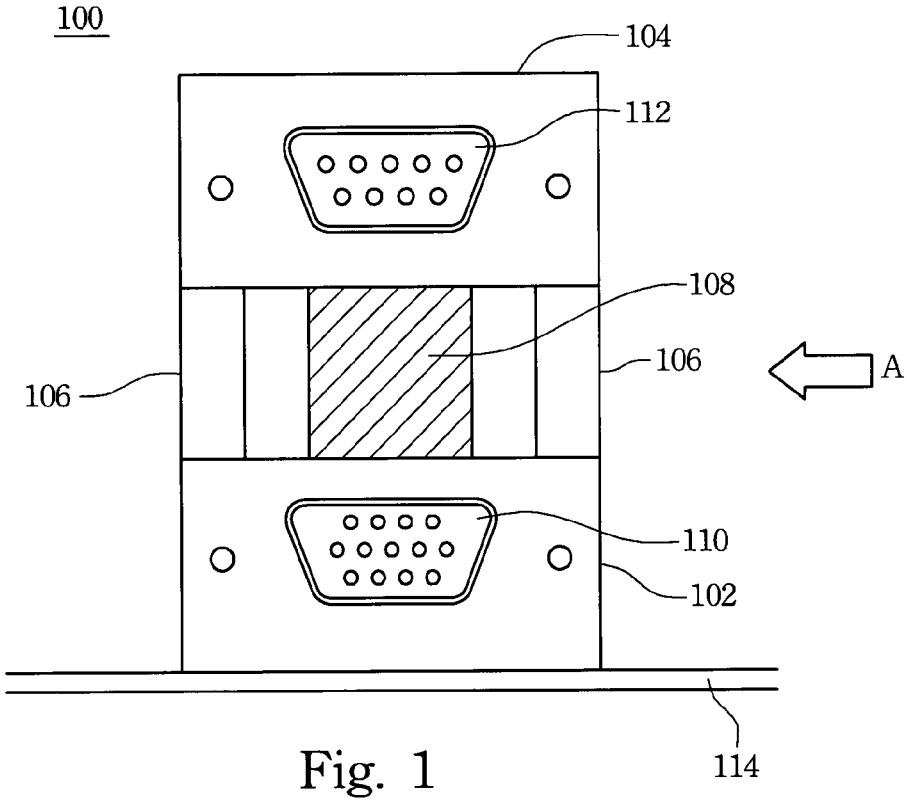
Fig. 1 (prior art)
FIG. 1 is a schematic diagram of a front view of a common stackable connector assembly.
Figure 2:
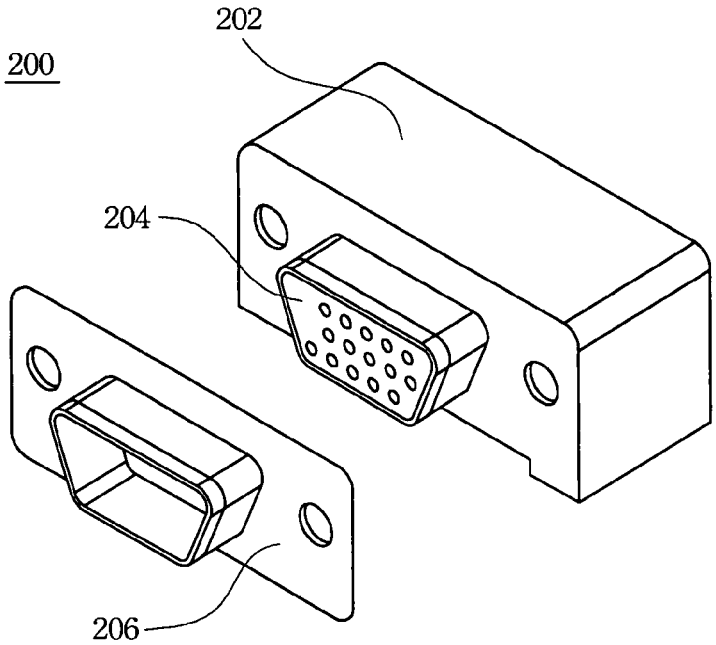
Fig. 2 (prior art)
FIG. 2 is a schematic diagram of an exploded view of a connector.
Figure 3:
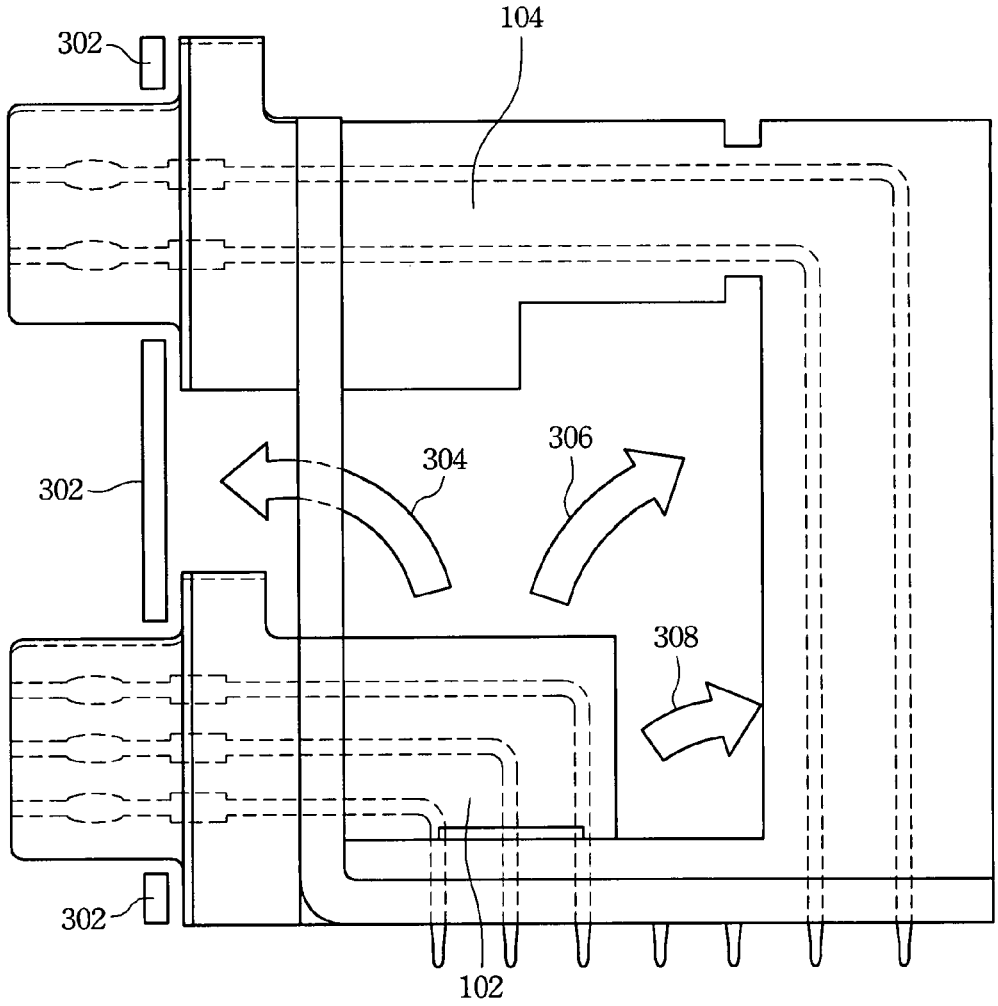
Fig. 3 (prior art)
FIG. 3 is a schematic diagram of a side view of a common stackable connector assembly from the A direction of FIG. 1.

Reference is now be made in detail to the present preferred embodiments of the invention, examples of which are illustrated in the accompanying drawings. Wherever possible, the same reference numbers are used in the drawings and the description to refer to the same or like parts.

There are several embodiments of the stackable connector assembly described herein. The specific is a grounded shielding member covered on one of the connector of the stackable connector assembly to reduce the electromagnetic interference. However, every interface corresponds to a specific connecter. For example, the pin number of the VGA interface connector is different from the serial port. Therefore, the categories of the stackable connector assembly are manifold. The shielding member is covered on the connector and grounded by connecting it to the ground member with the contact member in all embodiments. Someone skilled in the art could change the material and the method of the grounding and covering to satisfy other design or cost conditions.

First Embodiment

The shielding member is made of a thin metal in the first embodiment. The thin metal is covered on one of the connector. A contact member is arranged on the thin metal and contact to the ground member. The ground member is an electrically conductive shell of the connector. Due to the feature of the grounded electrically conductive shell of the connector, the thin metal is grounded.

Figure 4A:
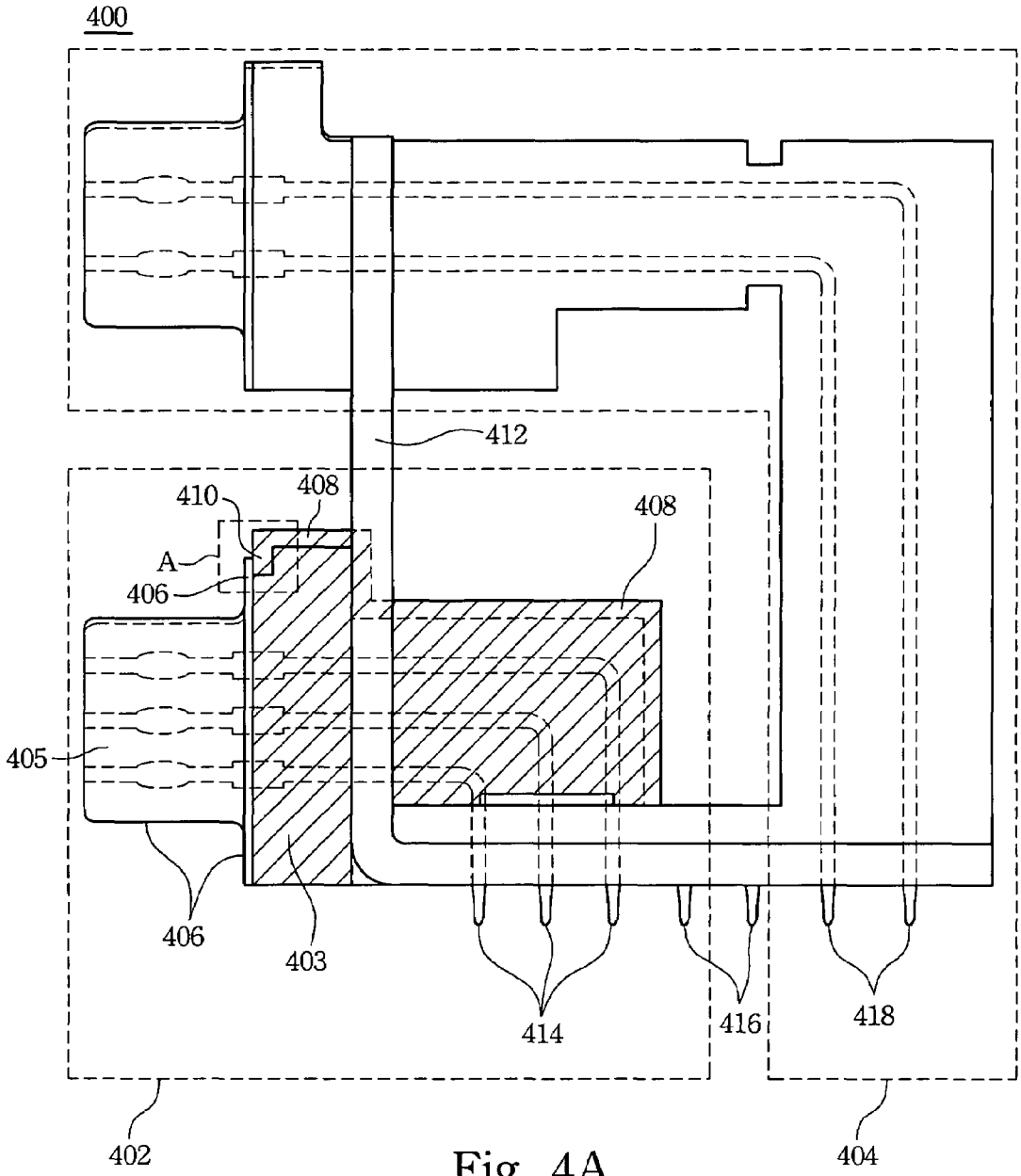
FIG. 4A is a schematic diagram of a side view of a stackable connector assembly with shielding structure of a first embodiment of the present invention.

Please refer to FIG. 4A. FIG. 4A is a schematic diagram of a side view of a stackable connector assembly 400 with a shielding structure of the first embodiment of the present invention. The stackable connector assembly 400 includes a first connector 402, a second connector 404, an electrically conductive shell 406, a shielding member 408, and a metal bracket 412. The second connector 404 is placed above the first connector 402. The first connector 402 further comprises a first raised portion 405. The first raised portion 405 protrudes from one side of the first connector 402 and is covered by the electrically conductive shell 406. The shielding member 408 is covered on the first connector 402 and is disposed between the first connector 402 and the second connector 404. The shielding member 408 has a contact member 410. The contact member 410 is in contact with the ground member. The ground member is the electrically conductive shell 406 of the first connector 402 in this embodiment.

The stackable connector assembly 400 is soldered on a motherboard by the first connector solder tails 414 and the second connector solder tails 418, so that the stackable connector assembly 400 can be mounted on the motherboard. Therefore a signal could be transmitted between the motherboard and the first connector 402, and could be transmitted between the motherboard and the second connector 404.

In this embodiment, there are two metal brackets 412, and the metal brackets 412 are L-shape. The metal bracket could be a single bracket and be integrated into the stackable connector assembly for different kinds of stackable connector assemblies in other embodiments. The first connector 402 and the second connector 404 are mounted between these two metal brackets 412. The first connector 402 is placed below the second connector 404. The second connector 404 is placed above the first connector 402.

In addition to hold the first connector 402 and the second connector 404, the metal brackets 412 are also capable of increasing the strength of the stackable connector assembly. Moreover, the metal brackets 412 are soldered on the motherboard by the metal bracket solder tails 416 to increase the connected structure stability between the stackable connector assembly 400 and the motherboard.

To reduce the electromagnetic interference on the second connector 404 from the first connector 402 in the high-speed data transmission process, the shielding member 408 is covered on the first connector 402 in this embodiment. The shielding member 408 is grounded by connecting the shielding to the electrically conductive shell 406 with the contact member 410.

Figure 4B:
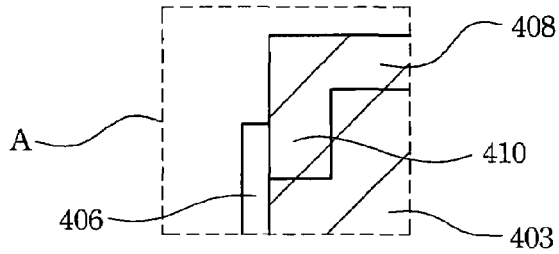
FIG. 4B is a schematic diagram of an enlarging view of the A part of FIG. 4A.

FIG. 4B is a schematic diagram of an enlarging view of the A part of FIG. 4A. In this figure, the contact member 410 is a portion of the shielding member 408. The contact member 410 is angled to contact with the electrically conductive shell 406 from the shielding member 408. Moreover, the contact member 410 is placed between the electrically conductive shell 406 and the first connector body 403 for contacting the electrically conductive shell 406 tightly. The contact member 410 also can be a salient point of the shielding member or other shapes. Moreover, the contact member 410 can contact with the electrically conductive shell 406 directly in other embodiment.

It is noted that the electrically conductive shell 406 can be grounded by being in contact with the I/O shielding which grounded through the connection with the computer case or the metal bracket 412 is known in the art. The shielding member 408 is grounded by connecting it to the electrically conductive shell 406 with the contact member 410. Therefore, the shielding member 408 has multi-grounded point and provides a shielding effect and reduces the electromagnetic interference from the first connector 402.

Second Embodiment

The thin metal is also used as a shielding member 408 to cover the connector. However, the ground member is the metal bracket, and the contact member contacts the metal bracket in this embodiment. Due to the metal bracket is soldered on the motherboard, the shielding member is grounded by the grounded motherboard.

Figure 5A:
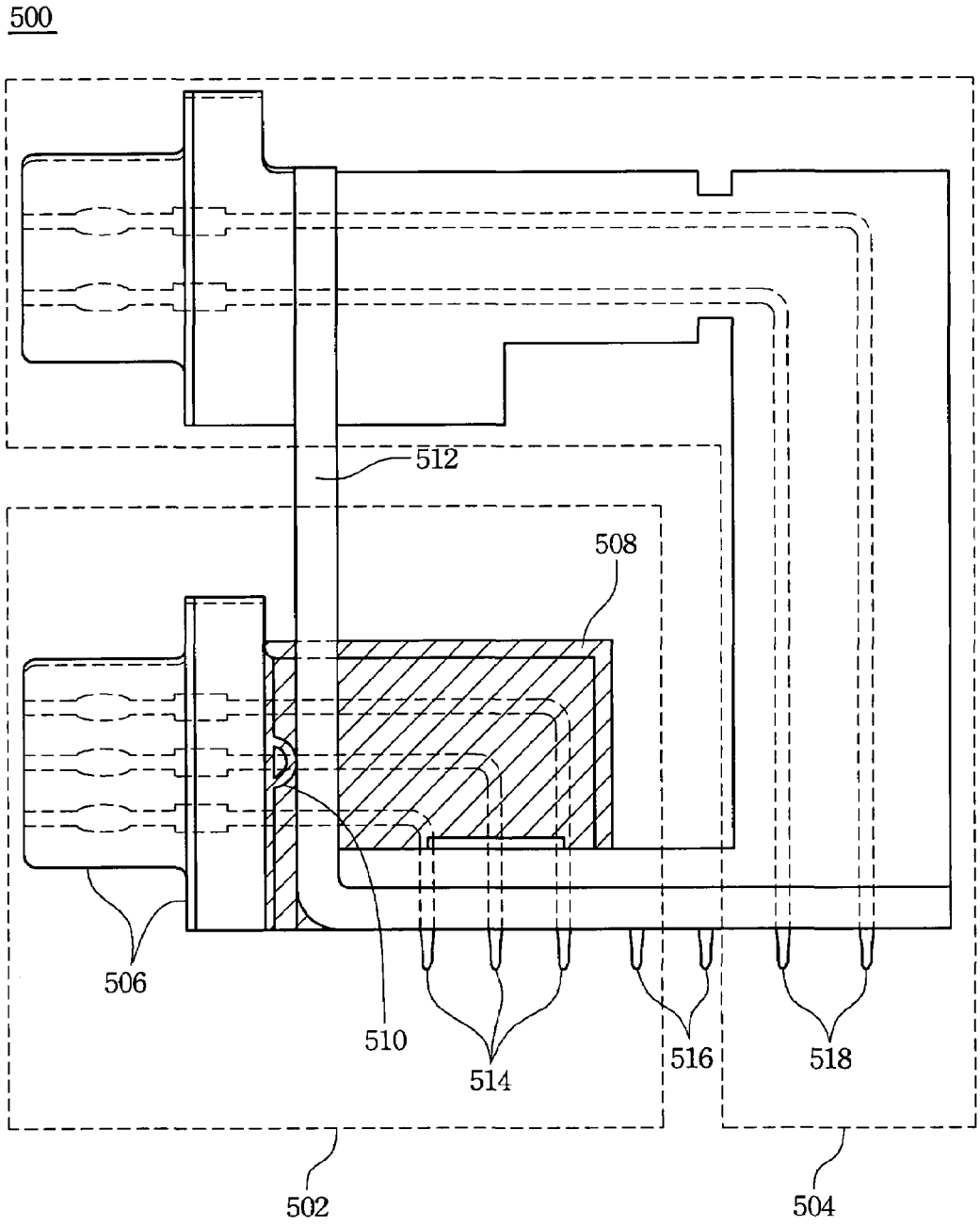
FIG. 5A is a schematic diagram of a side view of a stackable connector assembly with shielding structure of a second embodiment of the present invention.

Referring now to FIG. 5A, shown therein is a schematic diagram of a side view of a stackable connector assembly 500 with a shielding structure of second embodiment of the present invention. The stackable connector assembly 500 includes a first connector 502, a second connector 504, an electrically conductive shell 506, a shielding member 508, and a metal bracket 512. The second connector 504 is placed above the first connector 502. The shielding member 508 is covered on the first connector 502. The shielding member 508 has a contact member 510. The contact member 510 is in contact with the ground member. The ground member is the metal bracket 512 in this embodiment.

In this present embodiment, the stackable connector assembly 500 is known in the first embodiment, most elements and the method for mounting on a motherboard thereof will not be further described herein. The difference between these two embodiments is the arrangement of the contact member 510 of the shielding member 508 and the ground member.

Figure 5B:
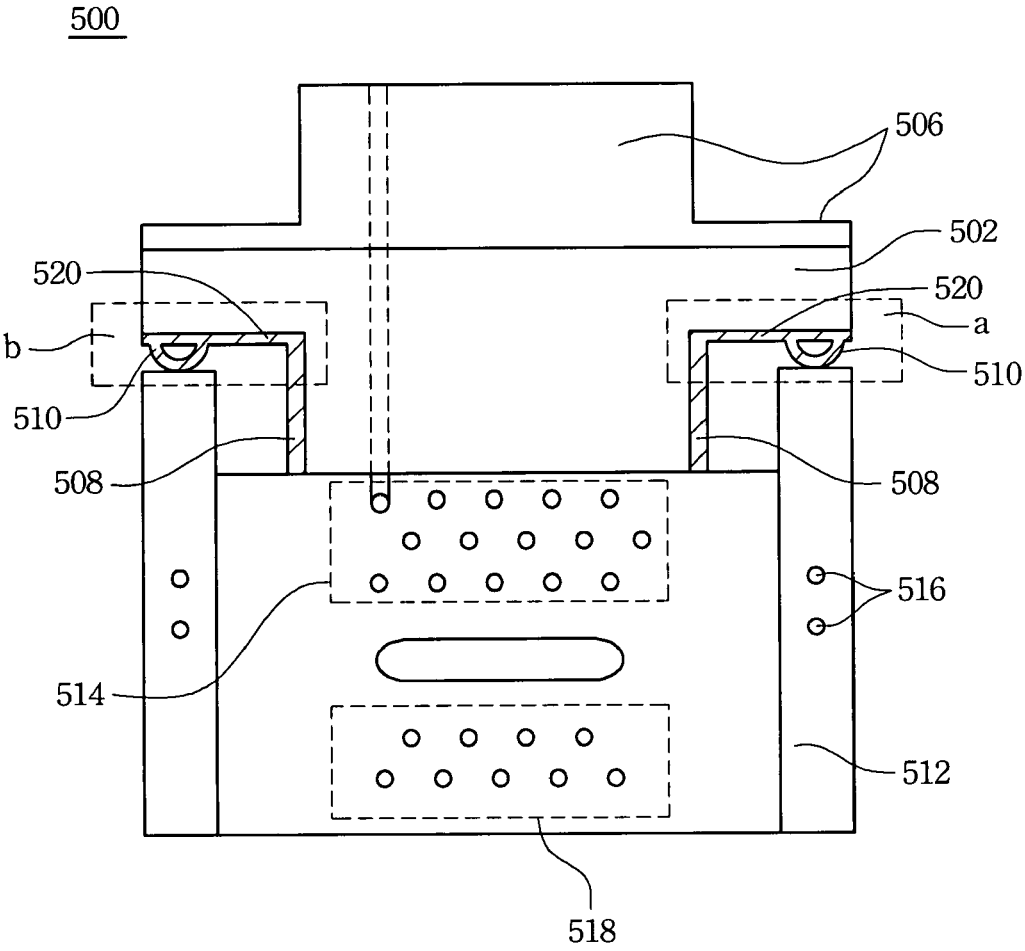
FIG. 5B is a schematic diagram of a bottom view of a stackable connector assembly of FIG. 5A.

For details describing the characteristic of this present embodiment, please refer to FIG. 5A and FIG. 5B together. FIG. 5B is a schematic diagram of a bottom view of a stackable connector assembly of FIG. 5A. This figure shows a first connector 502, the first connector solder tails 514, second connector solder tails 518, an electrically conductive shell 506, a shielding member 508, contact members 510, metal brackets 512, and metal bracket solder tails 516.

The shielding member 508 has two extended members 520 in the a extremity and the b extremity of the first connector 502. The contact members 510 are arranged on the extended members 520 to be in contact with the metal brackets 512. Of course, the contact members 510 are the portions of the shielding member 508. The shielding member 508 is grounded by connecting to the metal brackets 512 with the contact members 510.

In this embodiment, the contact members 510 are arc thin metal structures. Before installing the metal brackets 512, the shielding member 508 is pressed-fit on the first connector 502 first. In the process of installing the metal brackets 512, due to the elasticity of the arc thin metal structure, the contact members 510 can change shape a little with a force that from the metal brackets 512. Therefore, the contact members 510 are in tight contact with the metal brackets 512.

Third Embodiment

The stackable connector assembly with an EMI shielding structure in this present embodiment is almost entirely described in the first embodiment and the second embodiment, most elements and the method for mounting on a motherboard thereof will not be further described herein. Moreover, the contact members are arranged on two sides of the shielding member and contacted with the metal brackets, so that the shielding member can be grounded.

Figure 6:
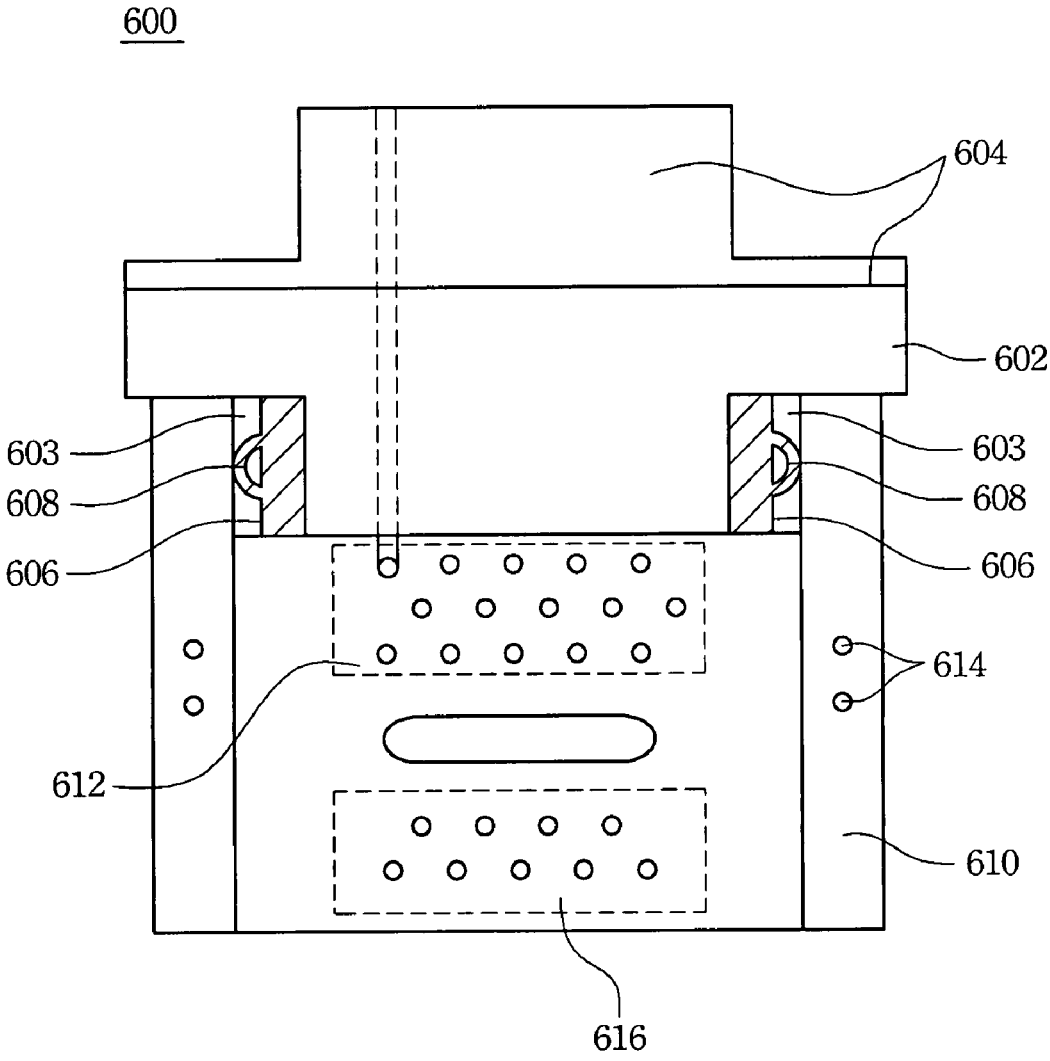
FIG. 6 is a schematic diagram of a bottom view of a stackable connector assembly with shielding structure of a third embodiment of the present invention.

Please refer to FIG. 6. FIG. 6 is a schematic diagram of a bottom view of a stackable connector assembly 600 with a shielding structure of the third embodiment of the present invention. This figure shows a first connector 602, first connector solder tails 612, second connector solder tails 616, an electrically conductive shell 604, contact members 608, metal brackets 610, and metal brackets solder tails 614. The shielding member 606 is covered on the first connector 602. The contact members 608 are arranged on two sides of the shielding member 606 to contact to the metal brackets 610.

In this embodiment, the contact members 608 are arranged on the sides of the shielding member 606 directly. Compare to the second embodiment, the third embodiment can reduce the area of the shielding member 606. In second embodiment, the shielding member extends the extended members, and is arranged the contact members on the extended members. Therefore, this embodiment is a cost down solution for the shielding member 606.

However, there is a space 603 between the metal brackets 610 and the first connector 602 of the conventional stackable connector assembly. The first connector 602 not contacts the metal brackets directly. The contact members arranged on the sides of the shielding member 606 could adapt to some size accuracy by the shape change of the contact members 606. If the space 603 between the metal brackets 610 and the first connector 602 is too large, it is possible that the contact members 608 cannot contact the metal brackets 610. Therefore, the specifications of devices in this embodiment are more critical. The choice of the embodiments is depended on the variations of manufacture conditions.

Figure 7:
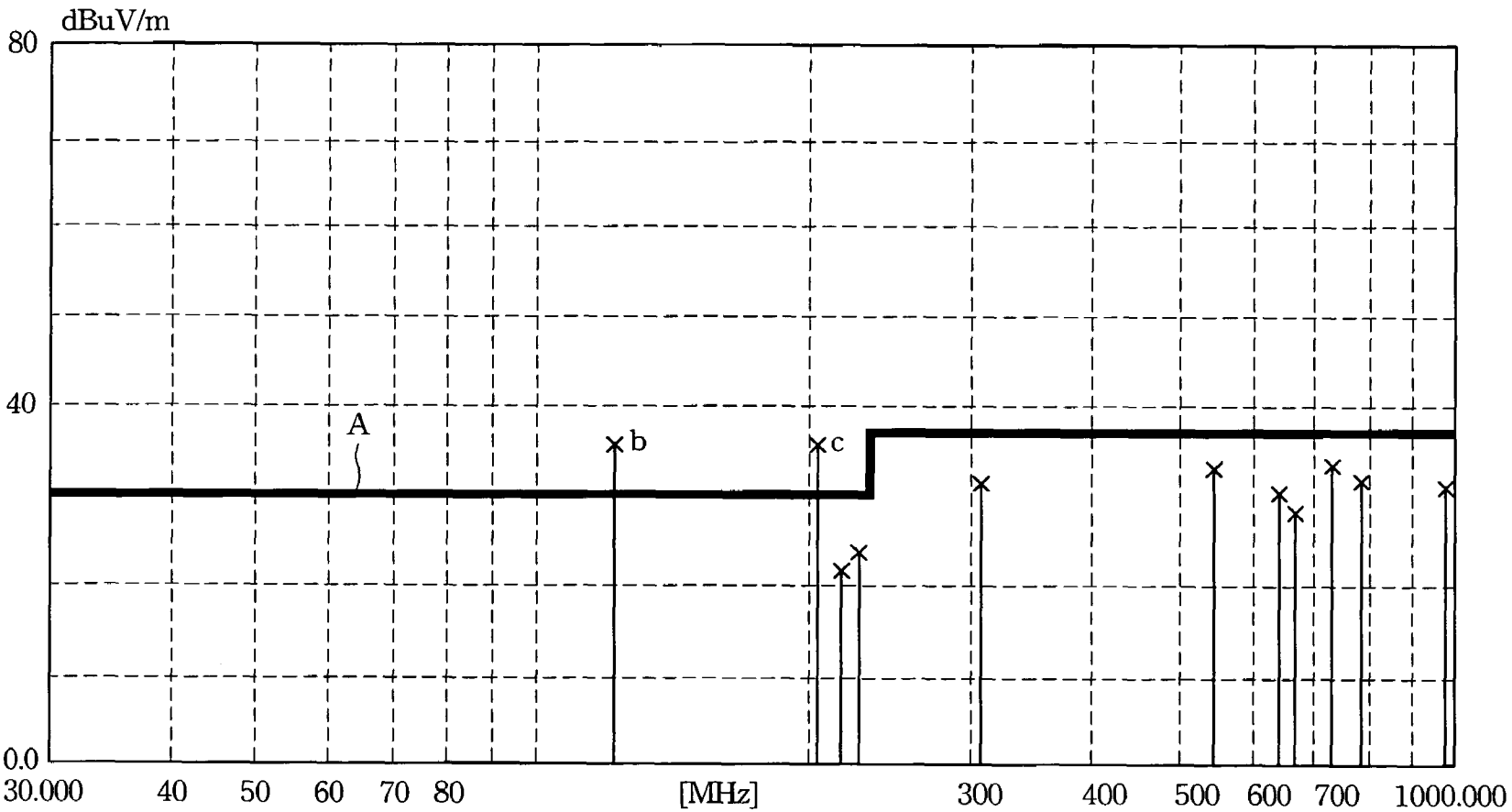
FIG. 7 is a schematic diagram of an EMI testing result of a first connector that without a shielding member.
Figure 8:
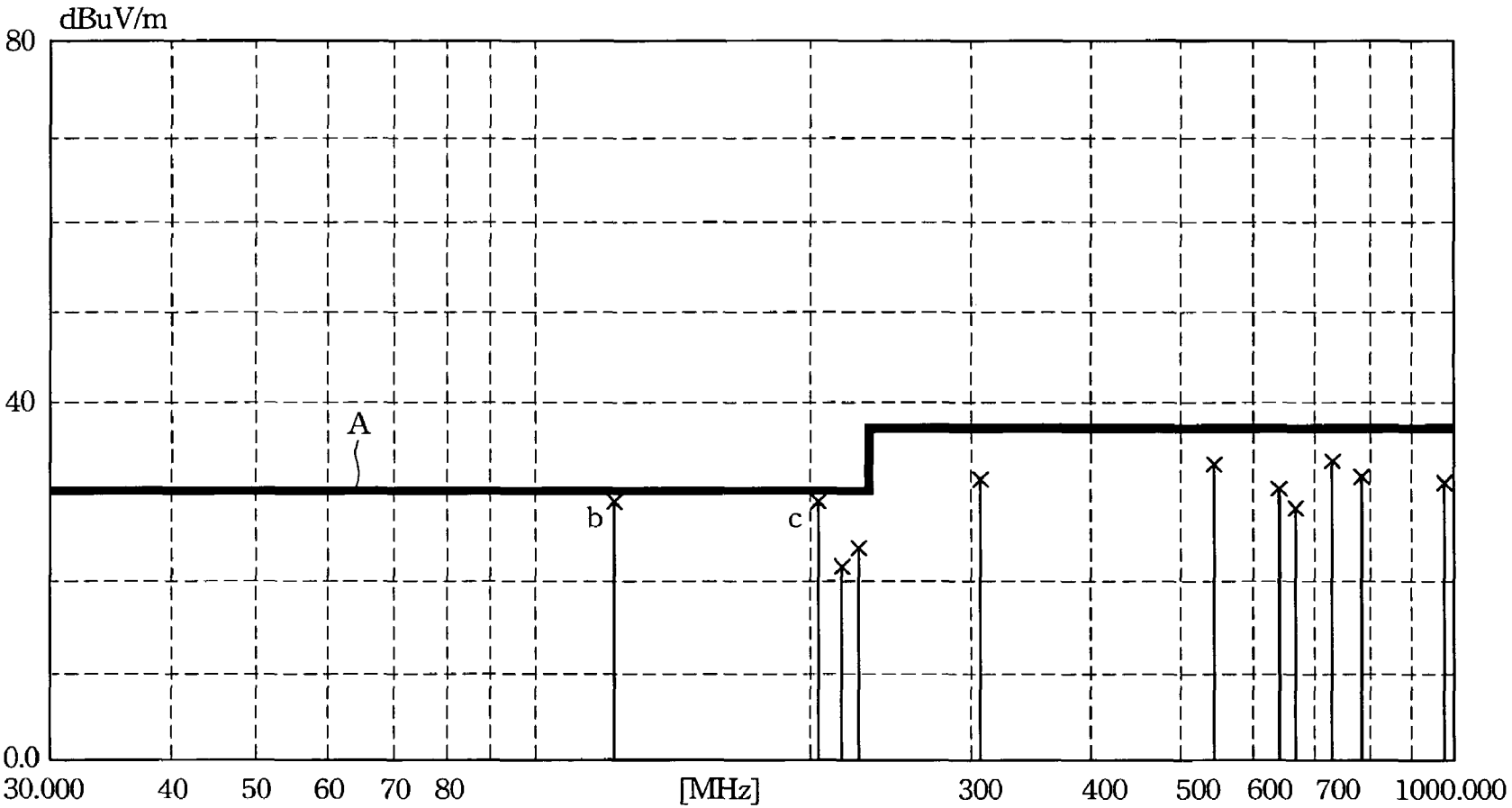
FIG. 8 is a schematic diagram of an EMI testing result of a first connector that covering a shielding member.

To know the impact of the embodiments of this invention, please refer to FIG. 7 and FIG. 8. FIG. 7 is a frequency domain of an EMI testing result of a first connector without a shielding member. FIG. 8 is a frequency domain of EMI testing results of a first connector covered with a shielding member. In these two figures, the longitudinal axis is the radiated emission level, the horizontal axis is the frequency unit and line A is the standard value. The radiated emission level of the electromagnetic radiation cannot be above line A.

In these two figures, the frequency b and c are radiated from the first connector. Compare and contrast the radiated emission level of frequency b and c of these two figures. The radiated emission level of frequency b and c in FIG. 7 are all above line A. In FIG. 8, the radiated emission level of frequency b and c are all below line A. For these testing results, it is understood that the shielding member covers on the first connector and the shielding member grounded by connecting it to the ground member with the contact member can reduce the electromagnetic interference.

In the variations of the above example, all shielding members are all made of a thin metal. However, there are different kinds of stackable connector assemblies and the manufacture methods thereof. Sometimes the thin metal shielding member can not be covered on the first connector completely in the modular manufacture or the monolithic manufacture, and the electromagnetic radiation still radiate toward the outside environment.

Figure 9:
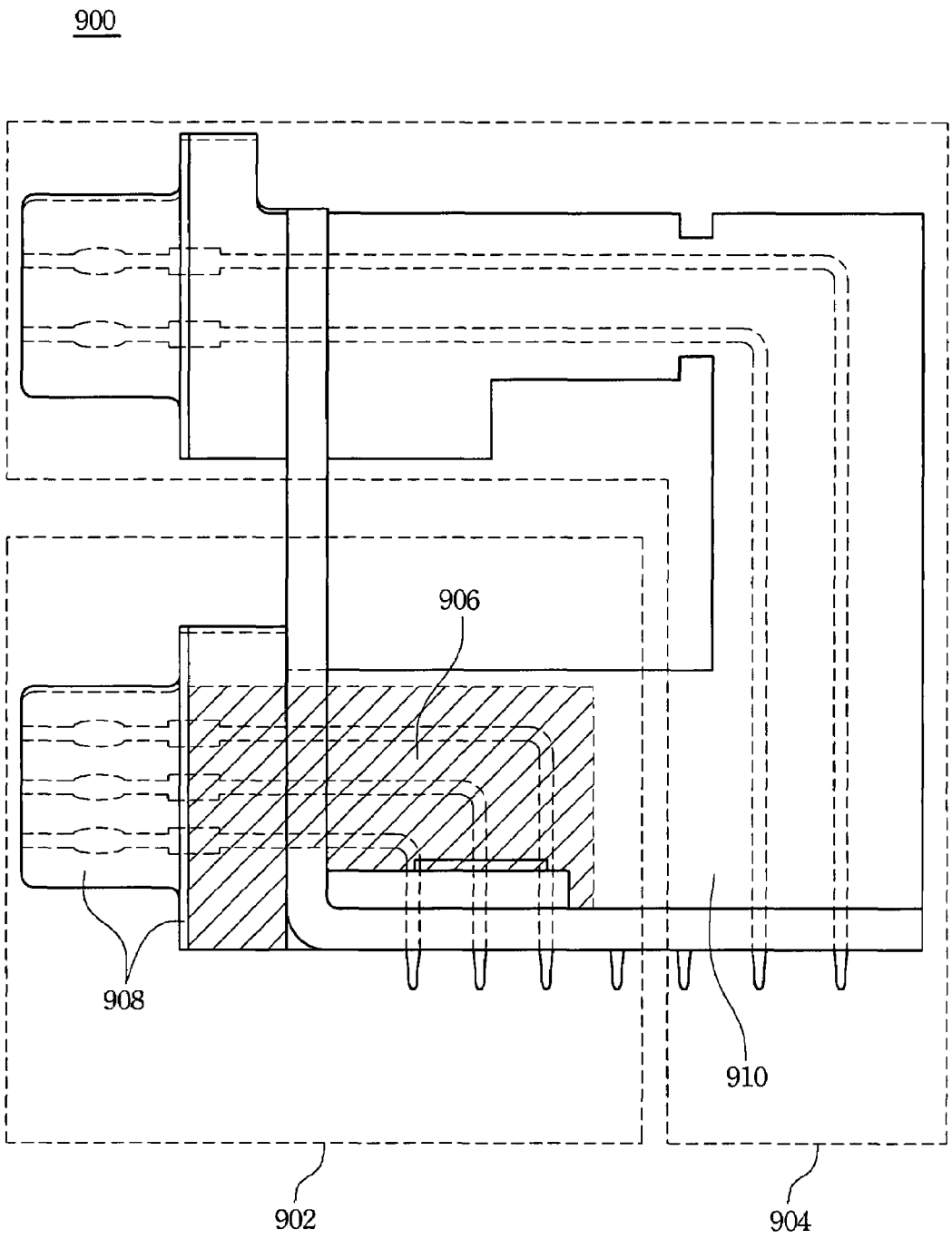
FIG. 9 is a schematic diagram of a side view of a stackable connector assembly with shielding structure of another embodiment of the present invention.

Please refer to FIG. 9. This figure is a schematic diagram of a side view of a stackable connector assembly 900 with shielding structure of another embodiment of the present invention. In this kind of stackable connector assembly 900, the first connector 902 and the second connector 904 are packaged by a plastic material 910, and the first connector 902 cannot be covered by the thin metal shielding member completely. Therefore, an electro-deposited metal coating layer 906 is added to the first connector 902. On lo the other hand, before molding the plastic material 910 to form the stackable connector assembly 900, a metal plating process is electroplated on an electro-deposited metal coating layer 906 first. The electro-deposited metal coating layer 906 is grounded by connecting it to an electrically conductive shell 908 in this embodiment. Moreover, the electro-deposited metal coating layer 906 can be grounded by other suitable grounding design.

The shielding member is the thin metal or the electro-deposited metal coating layer in the embodiments. In addition, there are many alternative metals that can be used for this present invention to satisfy other design or cost conditions, like EMI shielding compounds and other equivalents.

In this present invention, the shielding member is covered on the high-speed connector of the stackable connector assembly. The shielding member is grounded by connecting it to the ground member with the contact member. Therefore, the electromagnetic interference from the high-speed connector of the stackable connector assembly is reduced. Moreover, in most embodiments of this present invention, the shielding member is made of thin metal. It is a low cost and easily manufactured solution. In other embodiments, the shielding member can be made of an electro-deposited metal coating layer or EMI shielding compounds. The design of the contact member, the ground member, and the grounding method can be changed to satisfy the variations of manufacture conditions.

The above illustration provides many different embodiments or embodiments for implementing different features of the invention. Specific embodiments of materials and grounding method are described to help clarify the invention.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A stackable connector assembly comprising:

a first connector being a high-speed connector, having a first raised portion protruding from one side thereof, and an electrically conductive shell covering the first raised portion;

a second connector placed above the first connector, having a second raised portion protruding from one side thereof, and an electrically conductive shell covering the second raised portion; and a shielding member covering the first connector and disposed between the first connector and the second connector, and having as an integral portion thereof a contact member angled to interconnect with the electrically conductive shell of the first connector;

wherein the electrically conductive shell of the first connector is a ground member, and capable of grounding the shielding member.

2. The stackable connector assembly of claim 1, wherein the contact member is a portion of the shielding member, and is directly in contact with the electrically conductive shell.

3. The stackable connector assembly of claim 1, wherein the stackable connector assembly further comprises:

at least one metal bracket capable of increasing the strength of the stackable connector assembly.

4. The stackable connector assembly of claim 3, wherein the ground member is the at least one metal bracket.

5. The stackable connector assembly of claim 4, wherein the contact member is a portion of the shielding member, and the contact member is an arc thin metal structure, and is in contact with the at least one metal bracket.

6. The stackable connector assembly of claim 1, wherein the shielding member is a thin metal, an electro-deposited metal coating layer, or EMI shielding materials.

7. The stackable connector assembly of claim 1, wherein the contact member is a salient point of the shielding member.

* * * * *